US007543764B2

(12) United States Patent
Haynes et al.

(10) Patent No.: US 7,543,764 B2
(45) Date of Patent: Jun. 9, 2009

(54) COLD SPRAY NOZZLE DESIGN

(75) Inventors: Jeffrey D. Haynes, Stuart, FL (US); Stuart A. Sanders, Palm Beach Gardens, FL (US)

(73) Assignee: United Technologies Corporation, Hartford, CT (US)

( * ) Notice: Subject to any disclaimer, the term of this patent is extended or adjusted under 35 U.S.C. 154(b) by 493 days.

(21) Appl. No.: 10/401,427

(22) Filed: Mar. 28, 2003

(65) Prior Publication Data

US 2004/0191449 A1 Sep. 30, 2004

(51) Int. Cl.
*B05B 1/00* (2006.01)
*B05C 5/04* (2006.01)

(52) U.S. Cl. ..... 239/601; 239/79; 239/DIG. 19

(58) Field of Classification Search ..... 239/433, 239/434, 601, 79, DIG. 19, 423, 426, 428, 239/431, 398, 85; 427/191, 192, 195; 451/90, 451/102

See application file for complete search history.

(56) References Cited

U.S. PATENT DOCUMENTS 4,861,537 A * 8/1989 Ward et al. ..... 264/126
5,302,414 A 4/1994 Alkhimov et al.
6,139,913 A * 10/2000 Van Steenkiste et al. .... 427/191
6,402,050 B1 * 6/2002 Kashirin et al. ..... 239/79

FOREIGN PATENT DOCUMENTS

JP 2000-252248 9/2000
JP 2000-254554 9/2000

OTHER PUBLICATIONS

Boedeker Plastics, Inc., Celazole (Registered Trademark) Polybenzimidazole Specifications, Copyright Boedeker Plastics, Inc 2004, pp. 1-3.*

An article entitled "Experimental Evaluation of Several Ablative Materials as Nozzle Sections of a Storeable-Propellant Rocket Engine", By Peterson et al., published by Technical Memo Nasa US Government Information, (Apr. 1966.

* cited by examiner

*Primary Examiner*—Darren W Gorman
(74) *Attorney, Agent, or Firm*—Bachman & LaPointe, P.C.

(57) ABSTRACT

A nozzle for use in a cold spray technique is described. The nozzle has a passageway for spraying a powder material, the passageway having a converging section and a diverging section, and at least the diverging section being formed from polybenzimidazole. In one embodiment of the nozzle, the converging section is also formed from polybenzimidazole.

9 Claims, 5 Drawing Sheets

COLD SPRAY NOZZLE DESIGN

STATEMENT OF GOVERNMENT INTEREST

This invention was made with Government support under CRADA SC001/01589 awarded by the U.S. Department of Energy. The Government of the United States of America has certain rights in this invention.

BACKGROUND OF THE INVENTION

The present invention relates to an improved nozzle design for use in a cold spray system for depositing metal alloy coatings onto a workpiece.

Cold gas dynamic spraying (e.g. cold spray) is a relatively new technology where powder metal is deposited through solid state bonding. This bonding mechanism is achieved through acceleration of the particles to supersonic speeds through a converging/diverging (Laval) nozzle using helium and/or nitrogen gas. U.S. Pat. No. 5,302,414 to Alkhimov et al., which is hereby incorporated by reference herein, illustrates a cold gas dynamic spraying system.

Typical nozzle materials which have been used in cold spray systems include brass, stainless steel, and tool steel. During deposition of certain materials, namely aluminum and some nickel alloys, the nozzle will foul or clog with the metallic powder causing system failure and rework to remove the damaged nozzle. Fouling of aluminum occurs within a matter of 3-4 minutes, whereas a minimum of 8 hours continuous operation is desired to commercialize this new technology.

SUMMARY OF THE INVENTION

Accordingly, it is an object of the present invention to provide a nozzle which will provide a desired level of continuous operation.

The foregoing object is achieved by the present invention.

In accordance with the present invention, an improved cold spray nozzle comprises a passageway for spraying a powder material, the passageway having a converging section and a diverging section, and at least the diverging section being formed from polybenzimidazole. In one embodiment of the present invention, the converging section is also formed from polybenzimidazole.

Other details of the cold spray nozzle design of the present invention, as well as other objects and advantages attendant thereto, are set forth in the following description and the accompanying drawings wherein like reference numerals depict like elements.

DETAILED DESCRIPTION OF THE PREFERRED EMBODIMENT(S)

Figure 1:
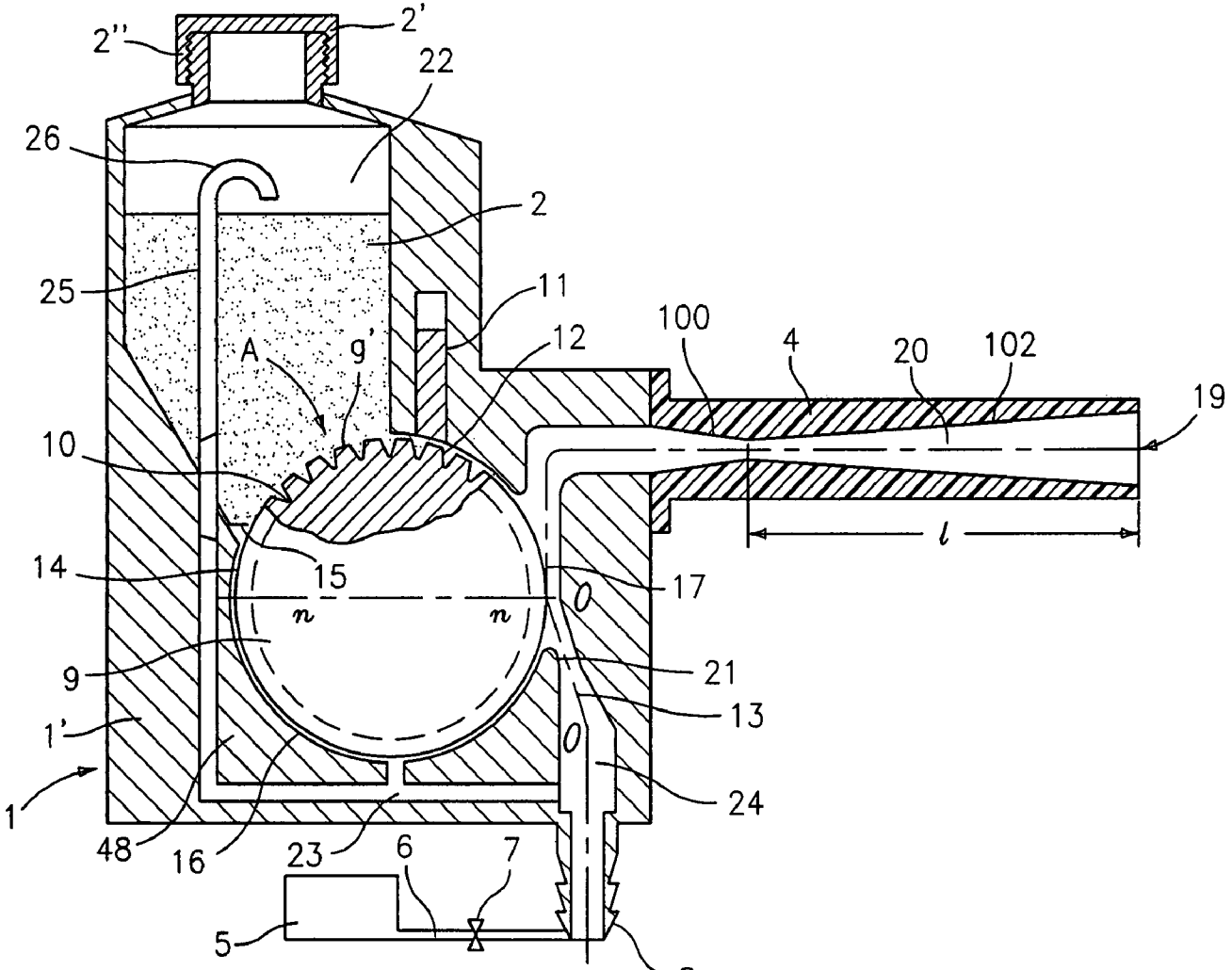
FIG. 1 illustrates a cold spraying system in which the nozzle of the present invention may be used.

Referring now to the drawings, FIG. 1 illustrates a system 10 for cold spraying a powder coating, such as an aluminum powder coating, to the surface of a product. The system 10 has a casing 1' which accommodates a hopper 2 for a powder having a lid 2' mounted by means of thread 2", a means for metering the powder, and a mixing chamber, all communicating with each other. The system also has a nozzle 4 for accelerating powder particles in communication with the mixing chamber, a compressed gas supply 5 and means connected thereto for supplying the compressed gas to the mixing chamber. The compressed gas supply means is in the form of a pneumatic line 6, which connects, via a shut-off and control member 7, the compressed gas supply 5 to an inlet pipe 8 of metering feeder 1. A powder metering means is in the form of a cylindrical drum 9 having on its cylindrical surface 9' depressions 10 and communicating with the mixing chamber and with the particle acceleration nozzle 4.

The system also comprises a powder particle flow controller 11 which is mounted in spaced relation 12 relative to the cylindrical periphery 9' of the drum 9 so as to ensure the desired mass flow rate of the powder during coating, and an intermediate nozzle 13 positioned adjacent the mixing chamber and communicating, via the inlet pipe 8 with the compressed gas supply means and with the compressed gas supply 5.

To prevent powder particles from getting into a space 14 between the drum 9 and casing 1' of the metering feeder 1 and thus to avoid the jamming of the drum 9, a baffle plate 15 is provided on the hopper bottom which intimately engages the cylindrical surface 9' of the drum 9.

To ensure a uniform filling of depressions 10 with the powder and its reliable admission to the mixing chamber, the drum 9 is mounted to extend horizontally in such a manner that one portion of its cylindrical surface 9' is used as a bottom 16 of hopper 2 and the other portion forms a wall 17 of the mixing chamber. Depressions 10 in the cylindrical surface 9' of the drum 9 extend along a helical line, which lowers fluctuations of the flow rate of powder particles during metering. To impart to a gas flow supersonic velocity with the predetermined profile, with high density and low temperature, and also to ensure acceleration of powder particles to a velocity ranging from 300 to 1200 m/s, nozzle 4 for acceleration of the powder particles is made supersonic and has a passageway 18 of profiled cross section. The passageway 18 of the nozzle 4 has a converging section 100 and a diverging section 102. Further, the passageway 18 preferably has one dimension of its flow-section larger than the other dimension and the ratio of the smaller dimension at an edge 19 of the nozzle to the length "1" of the supersonic portion 20 ranges from about 0.04 to about 0.01.

The passageway 18 has a construction which allows a gas and powder jet of predetermined profile to be formed, ensures efficient acceleration of the powder, and lowers velocity loss in the compressed gas layer upstream of the surface being coated.

A turbulence nozzle 21 of compressed gas flow admitted to a nozzle 13 through the pipe 8 and leaving the means for compressed gas supply is provided on the inner surface of the intermediate nozzle 13, at the outlet thereof in the mixing chamber. This turbulence nozzle 21 ensures an effective removal of powder and formation of a gas and powder mixture. To provide a recoil flow and ensure an effective mixing of powder and gas when the gas flow runs in the portion of the cylindrical surface 9' of the drum 9 forming wall 17 of the mixing chamber, intermediate nozzle 13 is mounted in such a manner that its longitudinal axis extends at an angle of from 80 degrees to 85 degrees with respect to a normal drawn to the cylindrical surface 9' of the drum 9.

The apparatus for applying a coating to the surface of a product also comprises means for supplying compressed gas to depressions 10 in the cylindrical surface 9' of drum 9 and a top part 22 of the hopper 2 to balance the pressure in the hopper 2 and the mixing chamber. The provision of such means removes the pressure exerted on the metering of the powder.

The means for gas supply in the form of a passage 23 in the casing 1' of the metering feeder 1 which communicates an interior space 24 of intermediate nozzle 13 with the top part 22 of the hopper 2 and which has a tube 25 connected to the intermediate nozzle 13, extends through the hopper 2 and is bent, at its top part, at an angle of 180 degrees.

The drum 9 is mounted for rotation in a sleeve 48 made of plastic material and being engaged with the cylindrical surface 9' of the drum 9. The plastic material of sleeve 48 is a fluoroplastic TEFLON which ensures the preservation of the shape of drum 9 by absorbing the powder particles. The provision of sleeve 48 lowers wear of the drum 9 and reduces alterations of its surface 9', and also eliminates its jamming.

The apparatus for applying a coating shown in FIG. 1 functions in the following manner. A compressed gas from the gas supply 5 is supplied along the pneumatic line 6, via shut-off and control member 7, to the inlet pipe 8 of metering feeder 1, the gas being accelerated by means of intermediate nozzle 13 and directed at an angle of between 80 and 85 degrees to impinge against the cylindrical surface 9' of the drum 9 which is stationary and then gets into the mixing chamber from which it escapes through the profiled supersonic nozzle 4. Supersonic nozzle 4 is brought to operating conditions (5 to 20 atm.) by means of the shut-off and control member 7, thus forming a supersonic gas jet at a velocity ranging from 300 to 1200 m/s.

The powder from the hopper 2 gets to the cylindrical surface 9' of the drum 9 to fill depressions 10 and, during rotation of the drum, the powder is transferred into the mixing chamber. The gas flow formed by the intermediate nozzle 13 and turbulized by the turbulence nozzle 21 blows the powder off the cylindrical surface 9' of the drum 9 into the mixing chamber wherein a gas and powder mixture is formed. The flow rate of the powder is preset by the number of revolutions of the drum 9 and space 12 between the drum 9 and powder flow controller 11. The baffle plate 15 prevents the powder from getting into the space 14 between the casing 1' and drum 9. The gas from intermediate nozzle 13 is additionally separated along passages 23 to be admitted into the space 12 between the drum 9 and the casing 1' to purge and clean it from the remaining powder, and through the tube 25, the gas gets into the top part 22 of the hopper 2 balances the pressure in the hopper 2 and the mixing chamber. The gas and powder mixture from the mixing chamber is accelerated in the supersonic portion 20 of the passage 18. A high-speed gas and powder jet is thus formed which is determined by the cross-sectional configuration of the passage 18 with the velocity of particles and density of their flow rate necessary for the formation of a coating. For the given profile of the supersonic portion 20 of passage 18, the density of mass flow rate of powder particles is specified by the metering feeder 1, and the velocity of particles is prescribed by the usable gas. For example, by varying the percentage of helium in a mixture with air between zero percent and 100 percent, the velocity of powder particles can be varied between 300 and 1200 m/s.

Figure 2:
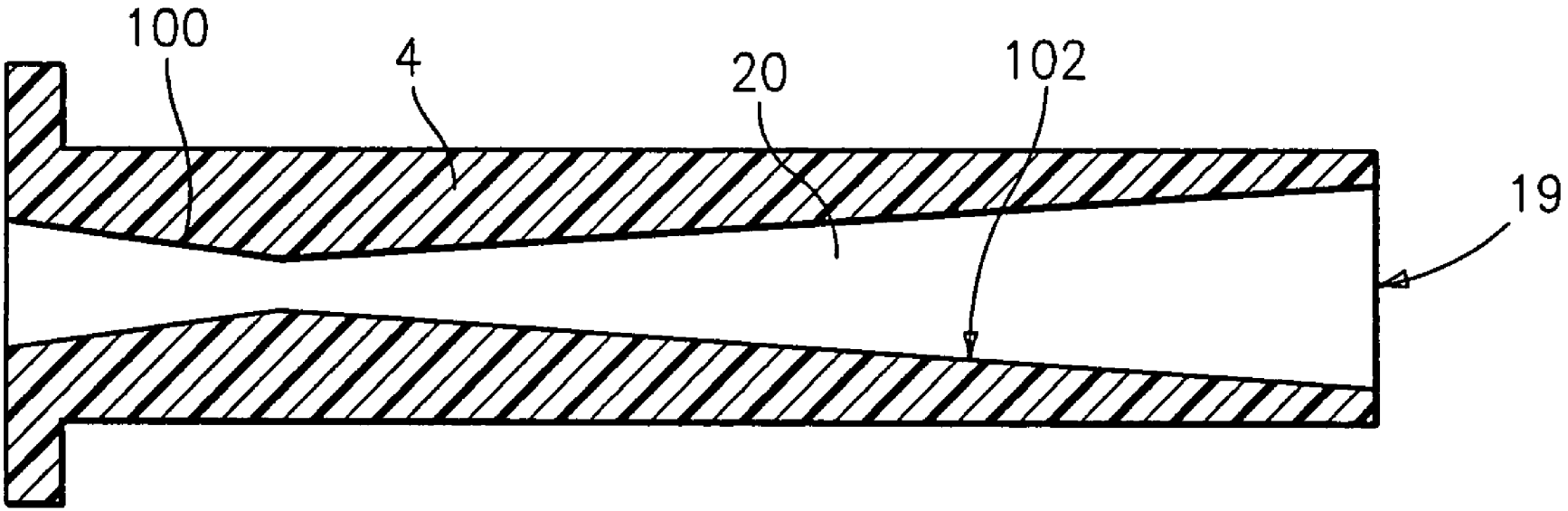
FIG. 2 is an enlarged cross sectional view of a cold spray nozzle in accordance with the present invention.

In accordance with the present invention, referring now to FIG. 2, clogging of the passageway 18 in the supersonic nozzle 4 is prevented by forming at least the diverging section 102 from polybenzimidazole. Polybenzimidazole has the formulation poly(2,2'-(m-phenylene)-5,5'-bibenzimidazole). Advantageously, both the converging section 100 and the diverging section 102 may be formed from this material in a single nozzle structure. Such a monolithic configuration of the nozzle. 4 is particularly useful when spraying aluminum and aluminum alloys onto a workpiece. Polybenzimidazole is stable up to 800 degrees Fahrenheit. It is a very hard polymer having a Rockwell E of 105 and excellent erosion resistance properties. Further, this material can be compression molded to whatever dimensions are needed. It can also be easily machined from barstock to very fine tolerances.

Figure 5:
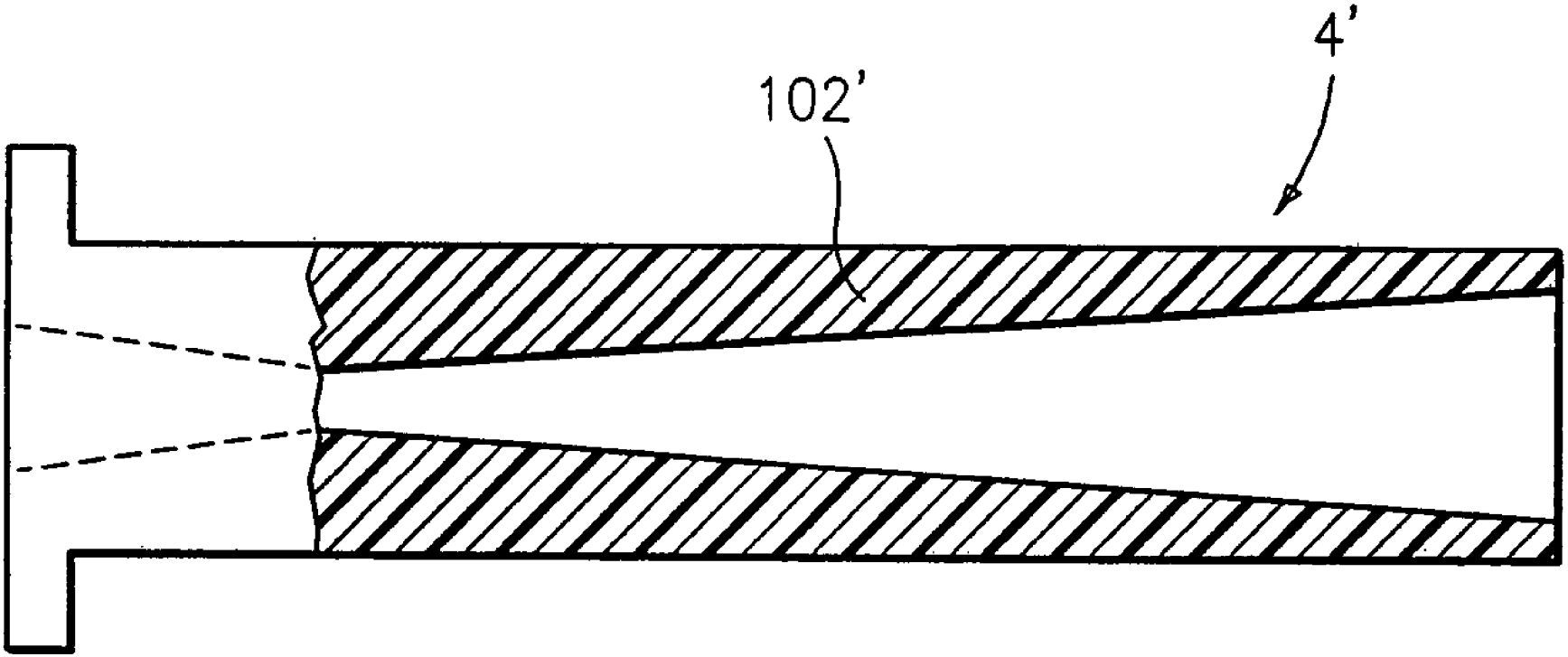
FIG. 5 illustrates an alternative embodiment of a nozzle which can be used with the cold spraying system of FIG. 1.

FIG. 5 illustrates a supersonic nozzle 4' having only a diverging section 102' formed from polybenzimidazole.

Figure 3:
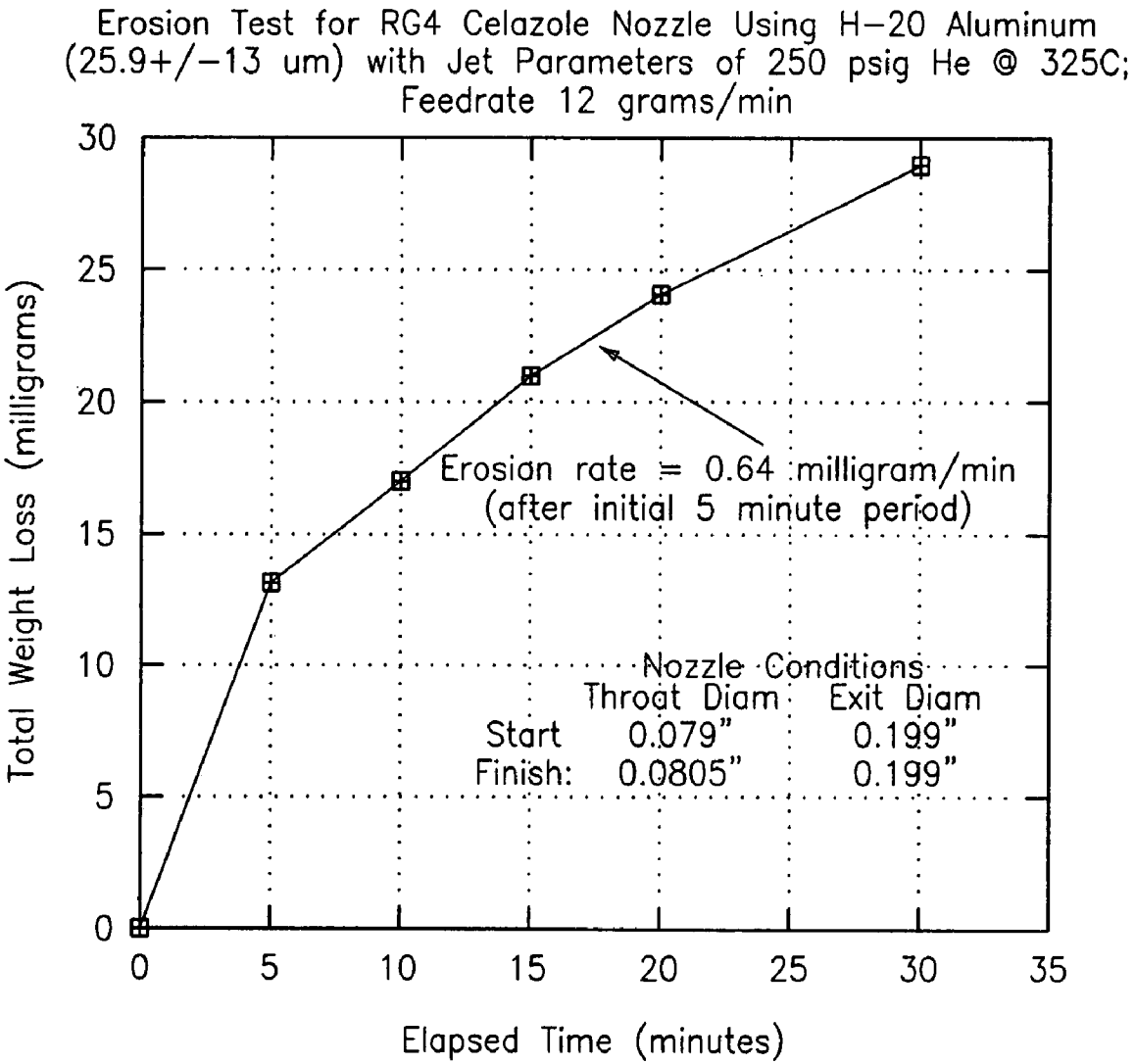
FIG. 3 is a graph showing erosion rate as a function of time for a nozzle made from polybenzimidazole.
Figure 4:
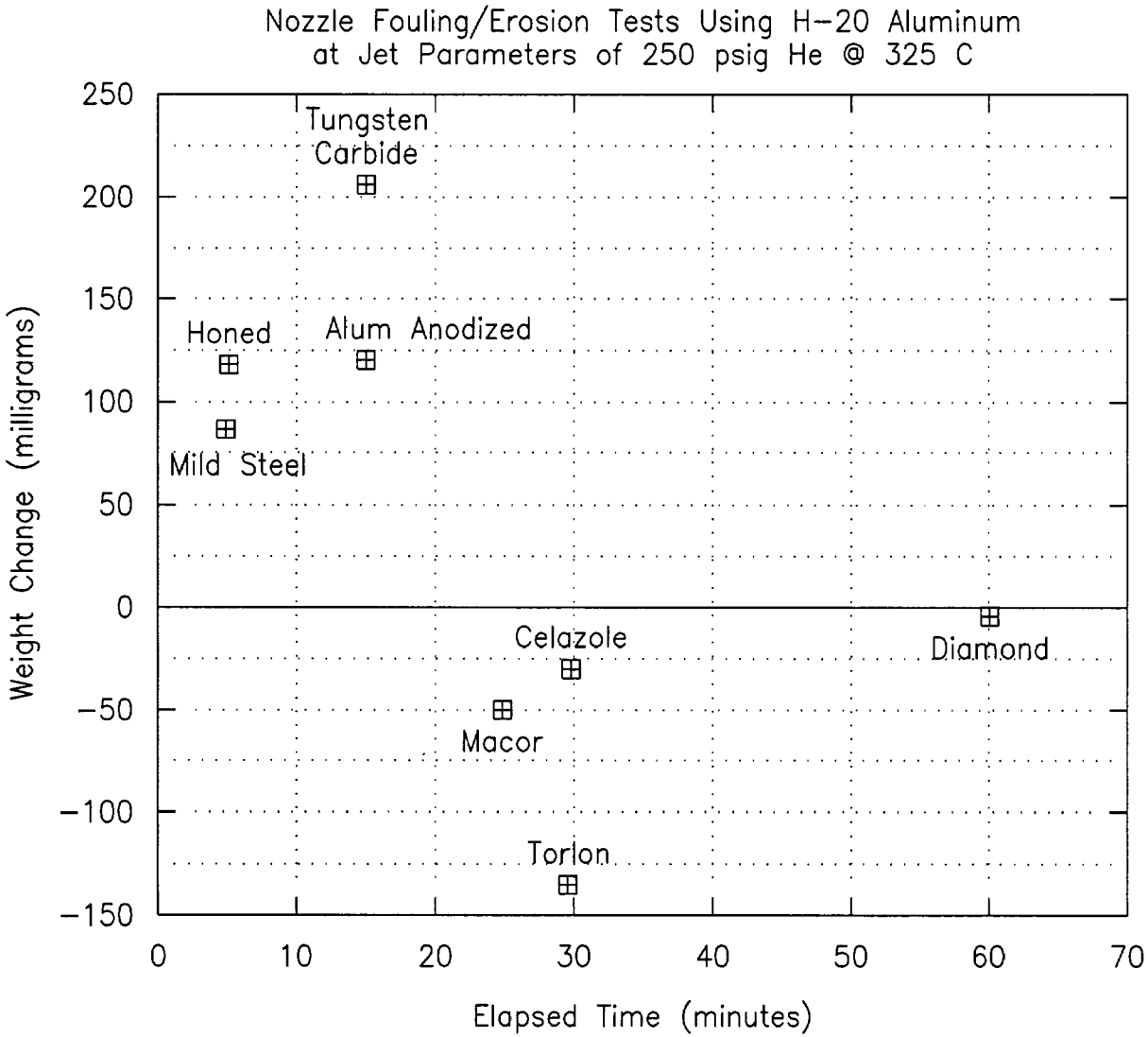
FIG. 4 is a graph showing the performance of various nozzle materials.

To demonstrate the advantages of using polybenzimidazole in a cold spray nozzle, a nozzle erosion test was performed using a nozzle formed from a monolithic polybenzimidazole structure. The jet conditions were 250 psig helium at 300 degrees centigrade using H-20 aluminum, which is a product name for 99.7% pure aluminum provided by Valimet Corporation, at a feed rate of about 12 grams per minute. FIG. 3 shows the erosion rate as a function of time for the nozzle. Most of the erosion occurred during the initial five minutes run period. This erosion occurred around the throat area between the converging and diverging sections. After the initial erosion, the nozzle lost about 0.64 milligrams per minute. FIG. 4 shows a ranking of nozzle materials in terms of weight change versus time. This figure shows that a nozzle formed from polybenzimidazole is better than a wide variety of other potential nozzle materials.

The test which was performed also showed no fouling when polybenzimidazole was used. Follow-on trials continue to demonstrate successful spraying of aluminum for eight hours without fouling.

It is apparent that there has been provided in accordance with the present invention a cold spray nozzle design which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A nozzle for use in a cold spray technique comprising:

a passageway for spraying a powder material, said passageway having a converging section and a diverging section, and said diverging section being formed from polybenzimidazole.

2. A nozzle according to claim 1, wherein both said converging section and said diverging section are formed from polybenzimidazole.

3. A cold spray system comprising:

a source of powdered material;

means for mixing said powder material with a gas;

a nozzle having a passageway communicating with said mixing means for spraying said powder material onto a workpiece;

said nozzle having a converging section followed by a diverging section; and said diverging section being formed from polybenzimidazole.

4. A system according to claim 3, wherein said converging section is also formed from polybenzimidazole.

5. A system according to claim 3, wherein said nozzle is a single nozzle structure.

6. A system according to claim 3, further comprising said nozzle having a smaller dimension at an edge and a supersonic portion having a length and the ratio of said smaller dimension to said length is in the range of from 0.01 to 0.04.

7. A system according to claim 3, wherein only said diverging section is formed from said polybenzimidazole.

8. A nozzle according to claim 1, further comprising said nozzle having a smaller dimension at an edge and a supersonic portion having a length and the ratio of said smaller dimension to said length is in the range of from 0.01 to 0.04.

9. A nozzle according to claim 1, wherein only said diverging section is formed from said polybenzimidazole.

* * * * *